US005169009A

United States Patent [19]

Bomze

[11] Patent Number: 5,169,009

[45] Date of Patent: Dec. 8, 1992

[54] RACK APPARATUS

[76] Inventor: Howard J. Bomze, 40 E. 20th St., New York, N.Y. 10003

[21] Appl. No.: 861,063

[22] Filed: Mar. 31, 1992

[51] Int. Cl.[5] ..... A47F 5/00

[52] U.S. Cl. ..... 211/74; 211/187; 211/189

[58] Field of Search ..... 211/74, 187, 189, 191; 248/165

[56] References Cited

U.S. PATENT DOCUMENTS

| | | | |
|---|---|---|---|
| D. 200,488 | 3/1965 | Watson . | |
| 3,559,339 | 2/1971 | Worley | 211/189 X |
| 3,606,023 | 9/1971 | Edmunds | 211/194 X |
| 3,870,155 | 3/1975 | Galloway . | |
| 4,697,713 | 10/1987 | Pryor | 211/189 |
| 4,715,503 | 12/1987 | Johnson | 211/189 |

*Primary Examiner*—Robert W. Gibson, Jr.
*Attorney, Agent, or Firm*—Darby & Darby

[57] ABSTRACT

A rack having support members in crossing horizontal and vertical arrangement. All of the support members are formed from similar stock having holes at a predetermined interval along the members. Circular or asymmetrical cross members extend between two sets of support members and are received in the holes. At a connection point, there are three abutting and aligned support members penetrated by a cross member to provide strength and support. Flat panels may be supported by the cross members to form a shelving system.

12 Claims, 4 Drawing Sheets

RACK APPARATUS

FIELD OF THE INVENTION

This invention relates generally to apparatus for storing and displaying articles. More specifically, this invention relates to an adjustable apparatus for storing and displaying wine bottles and other similar articles.

BACKGROUND OF THE INVENTION

The basic problem of storing and displaying cylindrical objects, such as wine bottles, was solved centuries ago with the invention of the wine rack. Since that time, however, the current available racks have progressed only slightly and have failed to meet certain needs.

The earliest wine racks were simple slats, usually of wood, joined by conventional fasteners, such as nails or screws. These racks, as with most furniture, are static once erected. The overall shape of the rack may not be changed without tearing it apart and rebuilding it. To attach more available storage space to the rack involves attaching more rack members with more permanent and damaging nail or screw fasteners.

Other, more modern, racks have become more like puzzles. Racks such as these are disclosed in U.S. Pat. Nos. 3,870,155 and 3,606,023. These racks resemble kits, with the particular rack pieces designed to fit together in a particular fashion, connected by intricate fasteners, such as the interlocking key of U.S. Pat. No. 4,715,503. Generally, these kits are designed to fit together in only one configuration. To produce a significantly different configuration usually requires additional pieces having different sizes than those already available in the kit.

In addition, these racks are usually designed to stand alone, or at best, to be stacked vertically or horizontally without interconnection. Gravity or simple abutment is relied upon to keep the rack units in place. However, the overall stability of stacked rack units that are not interconnected is greatly reduced.

SUMMARY OF THE INVENTION

Thus, it is an object of the invention to provide a rack for articles, such as wine bottles. It is a further object of the invention to provide a rack that is formed with structural members and without any further fasteners.

It is a further object of the invention to provide a rack that may be constructed in various configurations using the same structural members.

It is a further object of the invention to provide a rack that is adjustable to accommodate articles having different lengths.

It is another object that the rack be expandable without the use of connectors.

It is yet another object of the invention to provide a shelving system that is height, width, and depth adjustable and expandable without the use of connectors.

In accordance with the objects of the invention, a rack is provided having support members in crossing horizontal and vertical arrangement. All of the support members are formed from similar stock having holes at a predetermined interval along the members. Circular cross members extend between two sets of support members and are received in the holes. At a connection point, there are three abutting and aligned support members penetrated by a cylindrical cross member to provide strength and support. Flat panels may be supported by the cross members to form a shelving system.

BRIEF DESCRIPTION OF THE DRAWINGS

These and other objects, advantages and embodiments will become apparent to those skilled in the art upon reading the following detailed description in conjunction with a review of the appended drawings, in which.

DETAILED DESCRIPTION OF THE PREFERRED EMBODIMENTS

Figure 1:
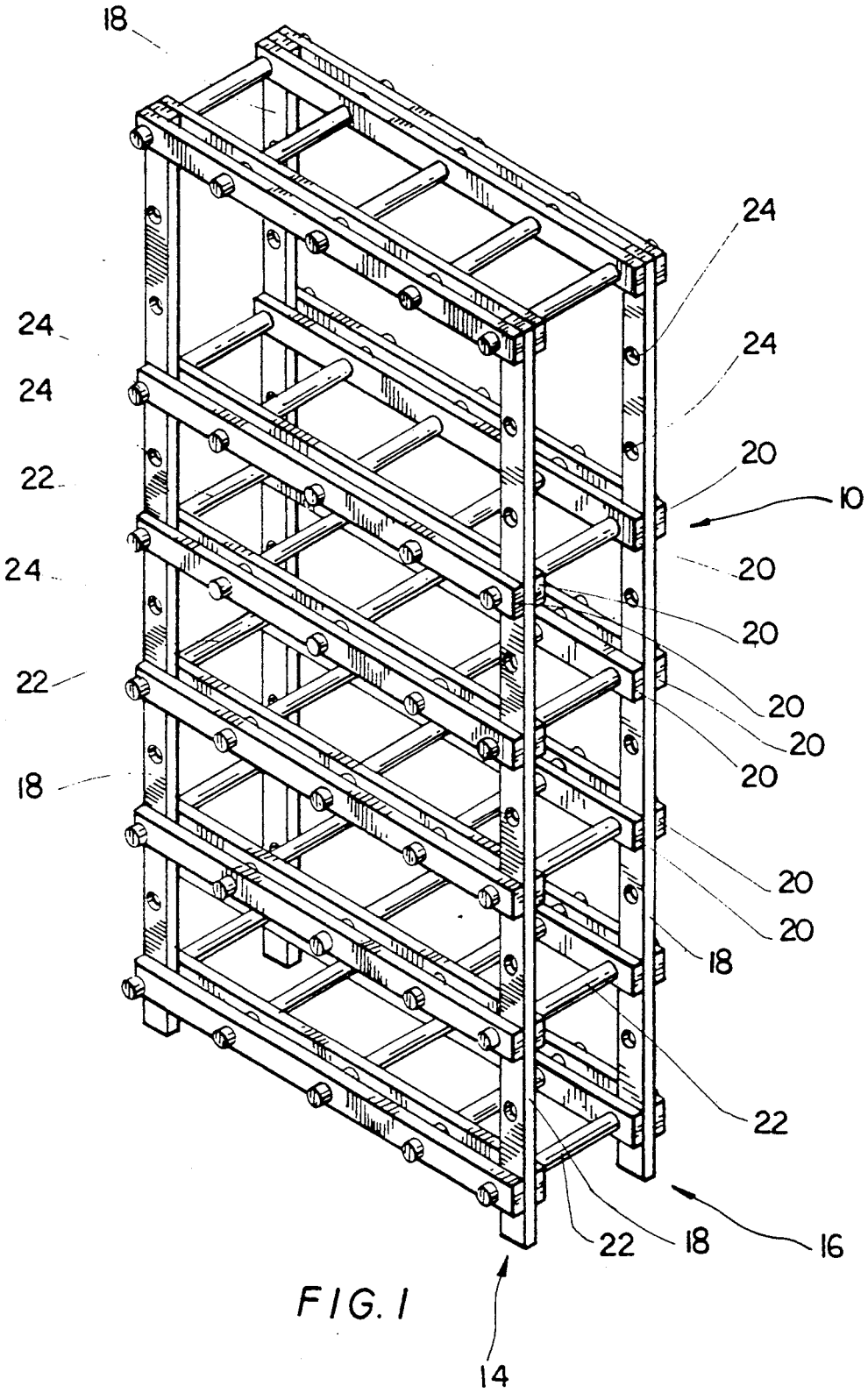
FIG. 1 is a perspective view of a rack according to the present invention.

Referring now to the drawings, FIG. 1 shows a perspective view of a rack 10 according to the invention. The rack is preferably designed for holding bottles 12 (FIG. 3), such as wine bottles, but can hold various articles as described more fully below. As seen in FIG. 1, the rack includes front support grid 14 and back support grid 16 that are generally identical. The grids 14,16 are formed by generally vertical support members 18 and horizontal support members 20. The support members 18,20 are inter-connected by cross members 22 that also span and interconnect the front and back support grids 14,16 to form a stable structure.

Figure 2:
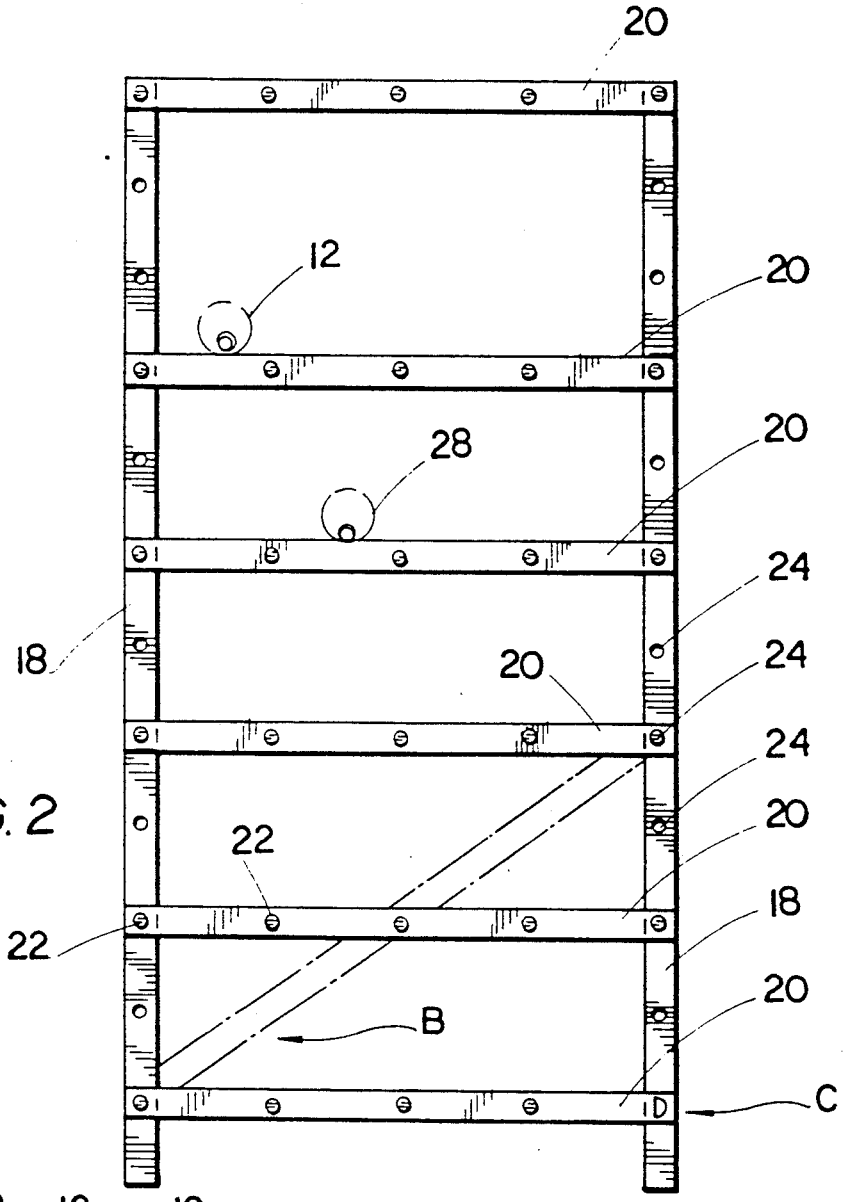
FIG. 2 is a front elevation view of a rack.

The support members 18,20 may be any length, which determines the overall size of the rack 10. Preferably, the support members 18,20 are formed by strips having a rectangular cross-section and made of material such as wood, although many materials will work similarly. Since the members 18,20 can all be made from the same stock, they are easy to manufacture and different length members can be used for vertical or horizontal members. Preferably holes 24 are formed at regular predetermined intervals along the support members. Longer support members 18,20 have more holes 24, as can be seen in FIG. 2.

Figure 4:
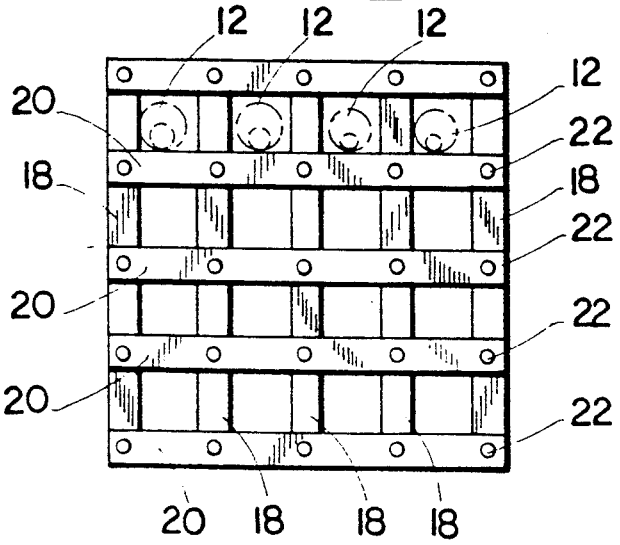
FIG. 4 is a front elevation view of an alternate rack according to the invention.
Figure 3:
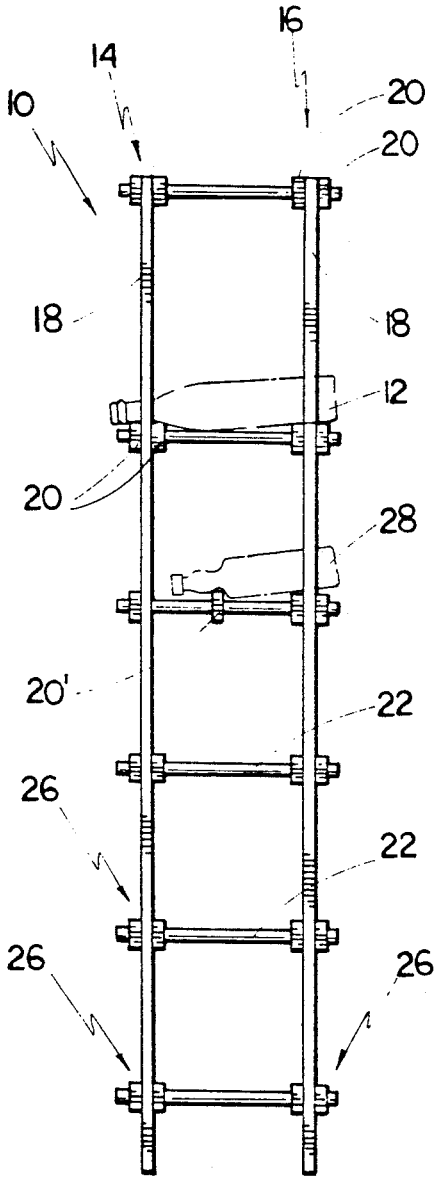
FIG. 3 is a side elevation view of a rack holding bottles.

As seen in FIGS. 3 and 4, a joint 26 preferably includes the intersection of three support members 18,20 and a cross member 22. At a joint 26, holes 24 of the three support members 18,20 align and receive the cross member 22. The holes 24 are formed with a size and tolerance such that the cross members 22 will have a press fit frictional connection with the support members 18,20. The overall depth of the three support members 18,20 when in abutting relationship, indicated at A, is preferably selected such that the depth will be at least about 200% of the diameter of the cross members 22. This will prevent skewing of the cross members 22 away from a position perpendicular to the support members 18,20.

The distance between the front and back grids 14,16 of the rack is preferably adjusted so that a standard wine bottle 12 will rest between the two grids 14,16 as shown in FIG. 3. It is preferred that the bottles 12 will be prevented from excessive sideways movement by engaging the vertical support members 18 such as is shown in the embodiment of FIG. 4. The length of the cross members 22 may be selected for various purposes. In the preferred embodiment, the cross members 22 will extend substantially only the distance between the front and back grids 14,16. However, alternatively, the cross members 22 can extend beyond the grids, such as behind the back grid 16 to abut a wall (not shown) and serve as spacers between the rack 10 and the wall. If the cross members were made double length, a third grid (not shown) could be added, doubling the capacity of the rack without doubling the materials. This can be useful for store displays having two sides.

For smaller bottles 28 or other articles that are shorter than the distance between the front and back grids 14,16, one or more of the horizontal support members 20' may be moved from one of the grids toward the other grid. For example, as shown at position B in FIG. 3, a horizontal support member 20' has been moved from the front grid 14 and slid along the cross members 22 to a position intermediate between the two grids 14,16. Thus, a smaller article, such as a small wine bottle 28, may now be suspended between the front grid 14 and the support member 20' or the back grid 16 and that member 20'.

The tolerance in manufacturing the holes 24 in the support members is critical to a certain extent, although some minor deviations in the regularity of the holes 24 may be beneficial to the stability of the rack 10, as described more fully as follows: If, when the various members 18,20 are configured to form the rack 10, the holes 24 do not line up exactly at a particular hole 24, it will be necessary to stress one or all of the support members 18,20 against other joints 26 to slightly deform those members and allow passage of the cross member 22. This will put the members 18,20 under tension, which will increase the frictional engagement between the members 18,20 and the cross member 22 and increase the strength of the joint 26. Of course, any necessary stress would be kept within the elastic region of the members 18,20, to prevent permanent damage, such as from cracking.

Figure 6:
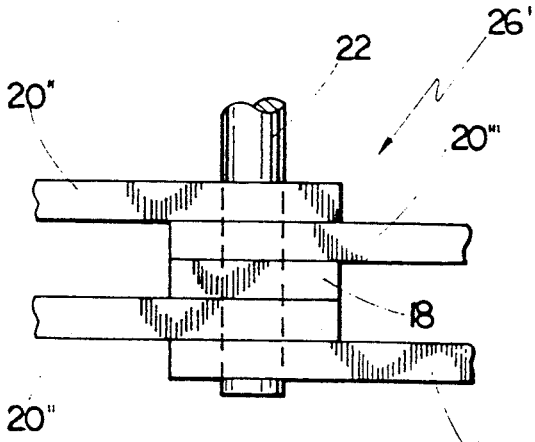
FIG. 6 is a top detail view of a joint of an expanded rack according to the present invention.
Figure 7:
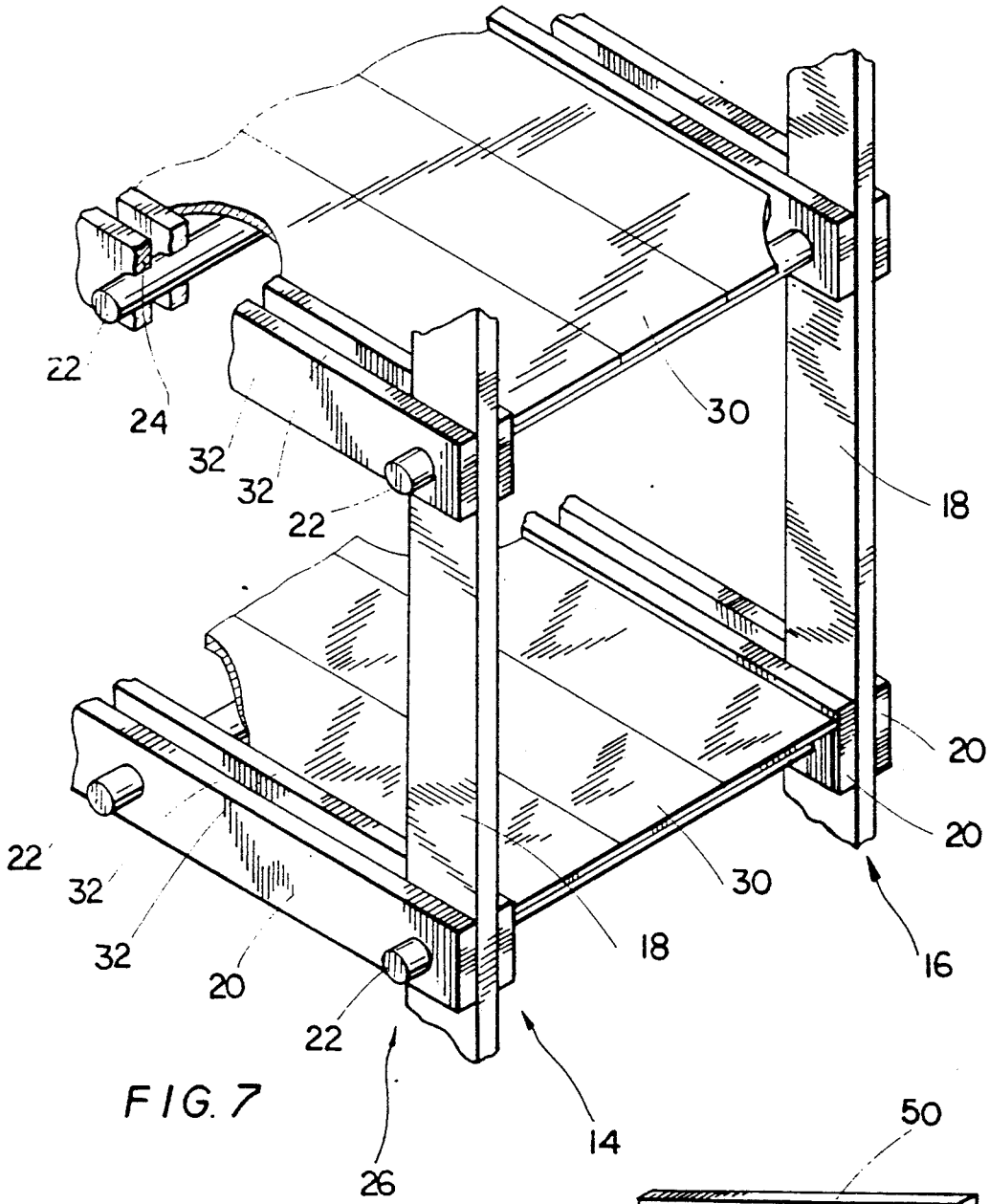
FIG. 7 is a partial perspective view of a shelving system according to the present invention.
Figure 8:
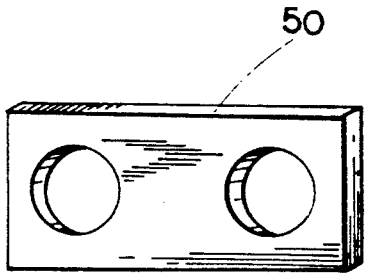
FIG. 8 is a front elevation view of a connector according to the present invention.

To convert the rack 10 of FIG. 1 into a shelving system, it is only necessary to lay shelf material 30, such as boards 30 (FIG. 6) over the cross members 22 of the rack 10. It is preferred that the shelves 30 be thin enough so that their top surface will not extend above the top 32 of the horizontal support members 20 chiefly for esthetic purposes. The shelves can be relatively thin compared to standard shelves because they are supported by multiple cross members 22. Since the cross members 22 preferably penetrate the horizontal support members below their top edge 32, the horizontal members 20 will trap the shelves between them. To prevent movement of the shelves 30 along the horizontal members, the shelves 30 preferably have a press fit with the horizontal members 20, or alternatively any known attachment method, such as adhesives or fasteners can be employed. Shelves 30 with varying depths can be used by moving horizontal members 20' as discussed above for smaller bottles 28. Alternatively, multiple horizontal members 20' could be added between the two grids 14,16 to form a shelf. This can be particularly useful for, for example, a plant stand that would allow water to pass through the gaps between the members 20'.

To strengthen the overall rack 10, it is contemplated that additional vertical members 18 may be added along any aligned column of holes 24 between the two vertical members 18 shown for each grid. Of course, more vertical members 18 will increase the load capacity of the rack. Having all of the columns occupied with vertical members will also create individual stations for bottles, preventing them from rolling side to side, such as is shown in FIG. 4.

It is also contemplated that various means can be employed to prevent vertical and horizontal members 18,20 from rotating about the axis of the cross members 22, and skewing the entire rack 10 from an orthogonal configuration. One method is to form the holes of the rack 10 into an asymmetric shape, such as a square or "D"-shape (as shown at C, FIG. 2). The cross members would have a complementary cross section, at least at their ends. This, of course, makes manufacturing the holes and cross members much more difficult. However, if the cross members were square, with square holes, the members would be easier to manufacture, perhaps balancing the more difficult holes. Alternatively, angle brackets (not shown) could be secured to the rack 10 after it is constructed, or diagonal members (shown in dotted line at B, FIG. 2) having holes could be mounted onto selected cross members, forming rigid triangles in the rack frame. However, these diagonal members may have to be of different lengths and hole spacings than the remainder of the pieces, making them unusable for any other purpose besides a diagonal member.

Figure 5:
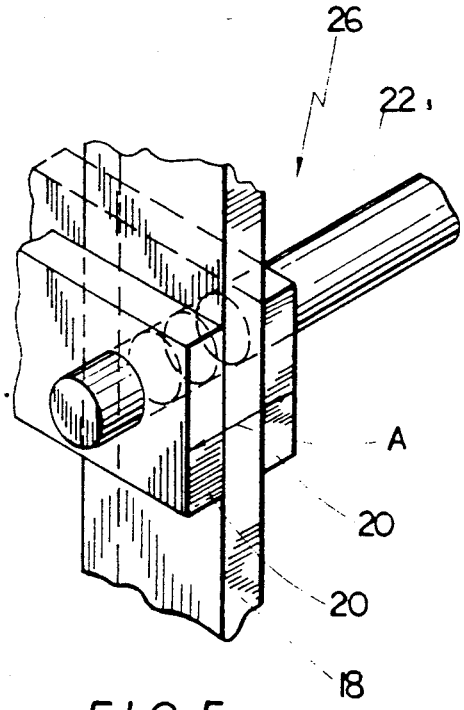
FIG. 5 is a detail perspective view of a joint of a rack according to the present invention.

In the preferred embodiment, the vertical and horizontal members 16,20 can be any length, while the spacing between the holes 24 is preferably uniform on all members 18,20. This allows many configurations of height, width and total bottle or article capacity to become possible. It is also possible with a limited variety of lengths, to extend rack 10 by simply interlocking adjacent racks 10. This may be accomplished without the use of additional connectors, as shown in FIG. 5. To connect two rack 10 as shown in FIG. 1, one horizontal member from the second rack 10 would be removed. The horizontal members 20'' from the second rack 10 are then preferably interleaved with the members 20'' of the first rack 10. The cross member 22 is then put through all five members 20'',20''',18. These joints 26' will be especially strong due to the larger ratio between the overall thickness of the support members and the diameter of the cross members.

Alternatively, to connect two racks 10, connectors 50 may be used to connect adjacent cross members 22 of two adjacent racks 10 by having the cross members 22 penetrate the holes 52. This maintains the front and rear horizontal members in the same planes, unlike the connection scheme shown in FIG. 6. These connectors can be used whether the racks are stacked side by side or vertically.

While the embodiments shown and described are fully capable of achieving the objects of the invention, it is to be understood that these embodiments are shown and described solely for the purpose of illustration and not for the purpose of limitation.

What is claimed is:

1. A rack for holding articles, comprising:

a plurality of horizontal and vertical first members forming a first grid lying generally in a first plane, each of said first members having a plurality of holes therethrough;

a plurality of horizontal and vertical second members forming a second grid lying generally in a second plane, said second plane being generally parallel to said first plane, each of said second members having a plurality of holes therethrough;

a plurality of cross members, each of said cross members extending between and being connected to said first and second grids, at least one of said cross members being received in aligned holes of three of said first members, said at least one of said cross members also being received in aligned holes of three of said second members.

2. A rack as in claim 1, wherein one of said first members is mounted on selected ones of said cross members and located between said first and second grids.

3. A rack as in claim 1, wherein each of said cross members is received in two horizontal first members, one vertical first member, two horizontal second members, and one vertical second member.

4. A rack as in claim 1, wherein the holes are uniformly spaced along all of the horizontal and vertical members.

5. A rack as in claim 1, wherein said cross members are cylindrical and said first and second members are flat.

6. A rack as in claim 1, further comprising a third member generally in the plane of one of said grids, said third member being positioned at a diagonal to horizontal members in said one of said grids.

7. A rack as in claim 1, further comprising a flat shelf member, said shelf member being supported by at least two cross members received in a particular horizontal first member.

8. A rack as in claim 1, wherein said cross members and said holes have complementary irregular cross sections, preventing relative rotation between said cross members and any of said first and second members.

9. A rack as in claim 8, wherein said cross members and said holes have a D-shaped cross section.

10. A kit for a rack for holding articles comprising:

a plurality of first longitudinal members, each of said first members having at least two spaced apart holes therethrough;

a plurality of second longitudinal members, each of said second members having at least two spaced apart holes of substantially the same size as the holes in said first longitudinal members therethrough;

a plurality of cross members having a diameter such as to create a friction fit when placed in the holes of the first and second longitudinal members;

whereby each of said cross members may be inserted into aligned holes of three of said first members lying generally in a first plane, one of said first members being at an angle to the others of said three of said first members, and each of said cross members also inserted into aligned holes of three of said second members lying generally in a second plane parallel to said first plane, one of second members being at an angle to the others of said three of said second members, to assemble said rack.

11. A kit as in claim 10 further comprising:

a flat shelf member, whereby said shelf member may be supported by at least two cross members lying generally in the same horizontal plane.

12. A kit as in claim 10, further comprising:

a third longitudinal member having a length less than the first and second members, said third member having two holes and being adapted for connecting said rack to another rack of similar construction.

* * * * *